United States Patent [19]

El-Kaddah et al.

[11] Patent Number: 5,014,769

[45] Date of Patent: May 14, 1991

[54] INDUCTION MELTING OF METALS WITHOUT A CRUCIBLE

[75] Inventors: Nagy H. El-Kaddah; Thomas S. Piwonka, both of Tuscaloosa; John T. Berry, Northport, all of Ala.

[73] Assignee: Inductotherm Corp., Rancocas, N.J.

[21] Appl. No.: 339,271

[22] Filed: Apr. 17, 1989

[51] Int. Cl.[5] ..... B22D 23/00; B22D 45/00; H05B 6/36

[52] U.S. Cl. ..... 164/493; 164/513; 219/10.43; 219/10.491; 219/10.79

[58] Field of Search ..... 164/493, 513, 471, 507; 219/10.43, 10.491, 10.67, 10.75, 10.79

[56] References Cited

U.S. PATENT DOCUMENTS

| | | | |
|---|---|---|---|
| 2,495,193 | 1/1950 | Wells | 219/10.67 X |
| 2,537,289 | 1/1951 | van Embden | 219/10.491 X |
| 2,686,864 | 8/1954 | Wroughton et al. | 164/498 |
| 2,686,865 | 8/1954 | Kelly, Jr. | 219/10.79 X |
| 2,957,064 | 10/1960 | Comenetz | 219/10.67 X |
| 3,100,250 | 8/1963 | Herczog et al. | 219/10.491 |
| 3,351,686 | 11/1967 | Gayet et al. | 219/10.43 X |
| 4,578,552 | 3/1986 | Mortimer | 219/10.41 |

FOREIGN PATENT DOCUMENTS

| | | | |
|---|---|---|---|
| 451484 | 9/1948 | Canada | 219/10.43 |
| 2907020 | 9/1979 | Fed. Rep. of Germany | 219/10.491 |
| 913610 | 3/1982 | U.S.S.R. | 164/507 |
| 1412627 | 11/1975 | United Kingdom | 164/493 |

OTHER PUBLICATIONS

Higginbotham, G. J. S., "From Research to Cost-Effective Directional Solidification and Single-Crystal Production—An integrated Approach," *Materials Science and Technology,* vol. 2, pp. 442-460, May 1986.

Piwonka, T. S. et al., "Manufacturing Method for Precision Casting Titanium Alloy Aircraft Components", Air Force Materials Laboratory, Tright-Patterson Air Force Base, OH, U.S. Dept. of Commerce, National technical Information Service, Jul. 1972.

Zotos, J. et al., "Ductile High Strength Titanium Castings by Induction Melting," American Foundrymen's Society Transactions, vol. 66, pp. 225-230, 1958.

*Primary Examiner*—Richard K. Seidel
*Assistant Examiner*—J. Reed Batten, Jr.
*Attorney, Agent, or Firm*—Seidel, Gonda, Lavorgna & Monaco

[57] ABSTRACT

The solid metal to be melted is placed within an induction coil which is adapted to provide a greater electomagnetic force towards the lower portion of the quantity of metal. The solid metal rests on a support, having an opening therethrough, which is kept at a low temperature relative to the metal as it melts. When energy is provided to the coil, the metal melts from the top downward, but the concentration of electromagnetic force towards the bottom of the metal causes the liquid metal to retain a cylindrical shape. When most of the metal is melted, the liquid metal passes through the opening in the support into a casting mold.

13 Claims, 2 Drawing Sheets

INDUCTION MELTING OF METALS WITHOUT A CRUCIBLE

FIELD OF THE INVENTION

This invention relates to the induction melting of a quantity of metal without the need for a crucible or other container. Instead, a magnetic field is used to contain the melt.

BACKGROUND OF THE INVENTION

In the manufacture of metal castings it is important to avoid contamination of the metal with non-metallic inclusions. These inclusions are usually oxide phases, and are usually formed by reaction between the metals being melted and the crucible in which they are melted. It has long been an aim of metalcasters to avoid such contamination by using crucibles which have minimum reactivity with the melts. However, some alloys, in particular nickel-based superalloys, which may contain substantial amounts of aluminum, titanium, or hafnium, react vigorously with oxide crucibles and form inclusions during melting.

In the case of titanium-base alloys and alloys of refractory metals (tungsten, tantalum, molybdenum, niobium, hafnium, rhenium, and zirconium), crucible melting is virtually impossible because of the violence of reactions with the crucible. So a related aim of metalcasters is to find a way to melt these alloys without contamination.

Heretofore there have been two main methods of avoiding contamination from a crucible in metal smelting. One method is "cold-crucible" melting, in which a water cooled copper crucible is used. The metal charge, which may be melted by induction, electric arc, plasma torch, or electron beam energy sources, freezes against the cold copper crucible wall. Thereafter, the liquid metal is held within a "skull" of solid metal of its own composition, instead of coming in contact with the crucible wall.

Another method is levitation melting. In levitation melting, a quantity of metal to be melted is electromagnetically suspended in space while it is heated. U.S. Pat. No. 2,686,864 to Wroughton et al. and U.S. Pat. No. 4,578,552 to Mortimer show methods of using induction coils to levitate a quantity of metal and heat it inductively.

Cold crucible melting and levitation melting necessarily consume a great deal of energy. In the case of cold-crucible melting, a substantial amount of energy is required merely to maintain the pool of molten metal within the skull, and much of the heating energy put into the metal must be removed deliberately just to maintain the solid outer portion. With levitation melting, energy is required to keep the metal suspended. In addition, as compared to the surface of a molten bath in a conventional crucible, levitation melting causes the quantity of metal to have a large surface area, which is a source of heat loss by radiation. Additional energy is required to maintain the metal temperature.

For alloys which are mildly reactive with crucibles, such as the nickel-base superalloys referred to above, a process called the "Birlec" process has been used. This process was developed by the Birmingham Electric Company in Great Britain. In the Birlec process, induction is used to melt just enough metal to pour one casting. Instead of pouring metal from the crucible conventionally, however, by tilting it and allowing the melt to flow over its lip, the crucible has an opening in its bottom covered with a "penny" or "button" of charge metal. After the charge is melted, heat transfer from the molten charge to the penny melts the penny, allowing the molten metal to fall through the opening into a waiting casting mold below.

By using a small quantity of metal with the proper induction melting frequency and power in the Birlec process, the metal can be "haystacked," or partially levitated, and held away from the crucible sides for much of the melting process, thus minimizing, although not eliminating, contact with the crucible sidewall. Such a process is in use today for the production of single crystal investment castings for the gas turbine industry. See, "From Research To Cost-Effective Directional Solidification And Single-Crystal Production-An Integrated Approach," by G. J. S. Higginbotham, *Materials Science and Technology*, Vol. 2, May, 1986, pp. 442–460.

The use of "haystacking" to melt refractory and titanium alloys was tried by the U.S. Army at Watertown Arsenal in the 1950s, using carbon crucibles. See, J. Zotos, P.J. Ahearn and H. M. Green, "Ductile High Strength Titanium Castings By Induction Melting", *American Foundrymen's Society Transactions*, Vol. 66, 1958, pp. 225–230. An attempt was made to improve on their results in the 1970s by combining the haystacking process with the Birlec process. See, T.S. Piwonka and C.R. Cook, "Induction Melting and Casting of Titanium Alloy Aircraft Components," Report AFFL-TR-72-168, 1972, Air Force Systems Command, Wright-Patterson AFB, Ohio. Neither of these attempts was successful in eliminating carbon contamination from the crucible, and there was no satisfactory method of controlling the pouring temperature of the metal to the accuracy desired for aerospace work.

In short, there has heretofore been no efficient way to melt and control pouring temperature which avoids crucible contamination. A need exists for such a way, particularly for highly reactive metals such as refractory metals and their alloys and titanium and its alloys, and for moderately reactive alloys such as nickel-based superalloys and stainless steels.

SUMMARY OF THE INVENTION

The invention is an apparatus and method for inductively melting a quantity of metal without a container. The quantity of metal, or "charge", is placed within an induction coil, which exerts on the metal an electromagnetic force which increases toward the bottom portion of the charge. The charge is free-standing on a support. The support has an opening therethrough, and further includes means for maintaining the support at a preselected temperature.

In a preferred embodiment of the invention, the apparatus comprises an induction coil having a plurality of turns disposed around a charge of metal to be melted. The coil comprises extra turns toward its lower portion so that a greater electromagnetic force is directed to the lower portion of the metal. The topmost of these turns is wound in a direction opposite that of the other turns. The charge is not in a crucible, but is free-standing in its non-molten state on a support. The support has an opening through it, through which liquid metal may pass as the charge melts.

The method comprises the steps of placing a charge of metal to be melted within an induction coil, and standing the charge on the support ring. Alternating electric current is passed through the coil, and the charge is melted inductively. The charge melts from its top portion downward. Because of the high electromagnetic forces provided by extra turns at the base of the induction coil, the liquid metal does not run down over the sides of the charge, but remains confined to the original space occupied by the solid charge. Eventually the heat transfer from the liquid metal to the remaining solid metal melts all of the solid metal except for a rim of solid metal which rests directly on the water-cooled support ring. The metal runs through the hole in the center of the support ring, directly to a casting mold.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
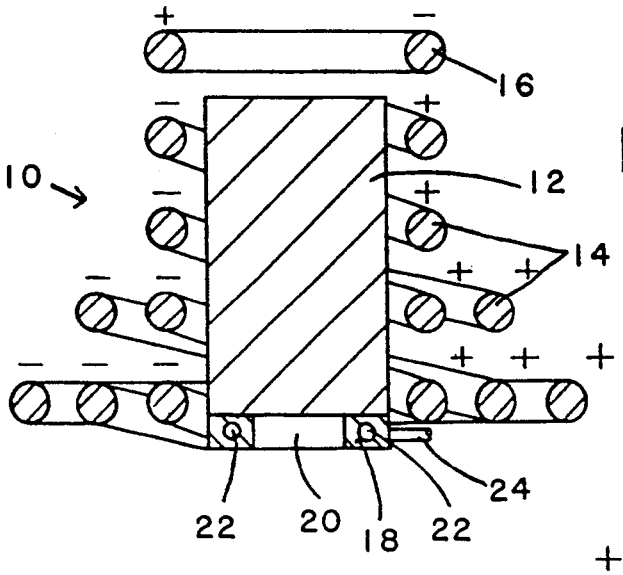
FIG. 1 is a schematic view of a charge of solid metal placed within the induction coil of the present invention and supported by a support.

FIG. 1 is a schematic view of the induction furnace of the present invention. A charge 12 of solid metal is located within an induction coil 10 having a plurality of turns 14. When energized in known manner, coil 10 generates a magnetic field which induces eddy currents within charge 12, thereby heating it. The general principles of induction heating and melting are well-known and need not be described here in detail.

Coil 10 also generates an electromagnetic force on charge 12 when coil 10 is energized. Turns 14 are arranged so that the electromagnetic force they produce will be concentrated toward the lower portion of the charge 12. In the preferred embodiment, the lower coils are doubled, tripled, or otherwise multiplied toward the bottom of the coil. Alternatively, the turns 14 could be arranged so that the turns toward the bottom of the charge 12 are closer to the charge 12 than the upper turns. Another alternative is to provide a plurality of separate power supplies, each corresponding to a different portion of the charge 12 and coil 14, so that the lower turns have more electrical energy associated with them.

The charge 12, before it is melted, rests on a support 18, which includes an opening 20 therethrough. Support 18 is illustrated as an annular ring, but it need not be annular. However, it is preferable that opening 20 be circular. Support 18 includes means for maintaining a preselected temperature, relatively cold compared to the charge 12 as it is melted. A typical means for cooling support 18 comprises internal cavities 22 through which a liquid coolant, supplied by tube 24, circulates. A preferred material for support 18 is copper.

The topmost turn 16 of the induction coil 10 is wound in a direction opposite that of the other turns 14 of the induction coil. This reverse turn has the effect of preventing the charge 12 from partially levitating or hay-stacking. If the metal were to be partially levitated, the excess surface area created by the partial levitation would be a source of heat loss by radiation, which would decrease the melting efficiency of the coil. Levitation may also be prevented by the use of a suitably designed passive inductor such as a disc, ring, or similar structure located above charge 12 which suppresses the levitation forces.

The solid charge 12 is placed within the coil 10 in direct proximity to, but out of physical contact with, the turns 14. It should be emphasized that no crucible is used. The coil turns 14 are arranged so that the magnetic force that is generated supports the metal as it is melted and confines it to a cylindrical volume concentric with the center of the coil, while levitation of the melt is prevented by the arrangement described above.

Figure 2:
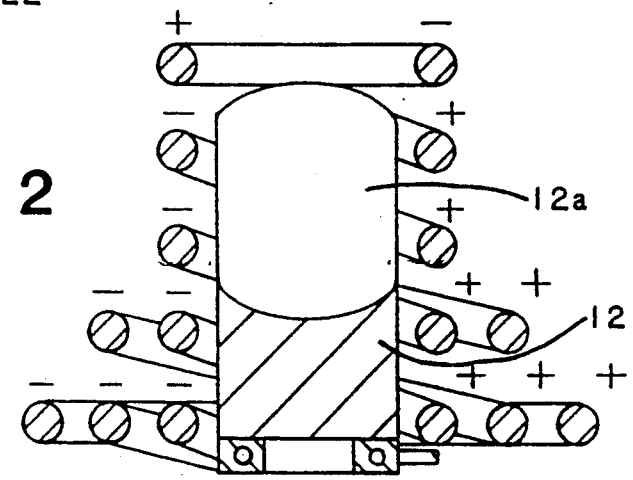
FIGS. 2 and 3 show subsequent steps of the melting of the charge in the induction coil. In these Figures solid metal is represented by cross-hatching.
Figure 3:
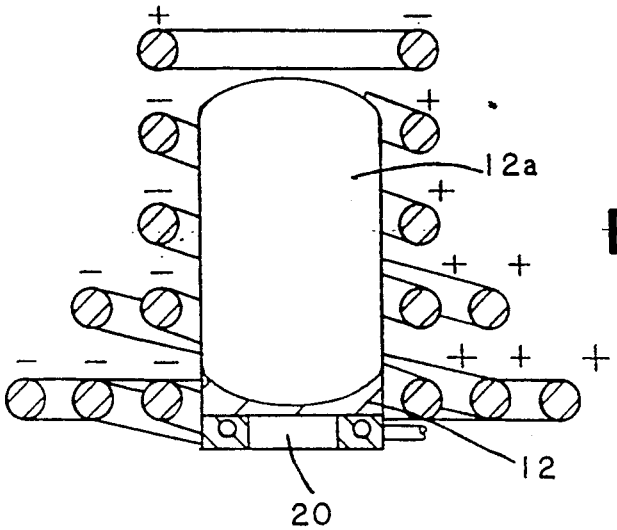

When power is applied to the coil 10, the metal begins to melt from the top of the charge (solid metal 12 is shown cross-hatched, and liquid metal **12*a* is shown stippled) as shown in FIG. 2. As melting proceeds, as shown in FIG. 3, the liquid portion 12*a* increases and moves down the charge. Because of the high magnetic forces provided by the extra turns at the base of the induction coil 10, the liquid portion 12*a* does not run over the sides of the charge 12 but remains confined to the original space occupied by the solid charge 12**.

Figure 4:
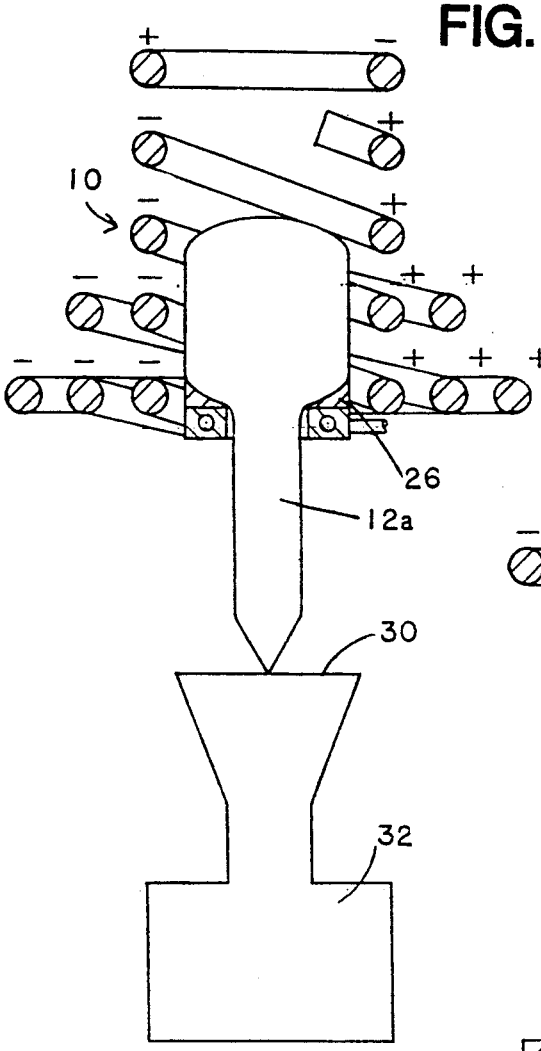
FIG. 4 is a schematic view of the molten metal within the induction coil of the present invention being poured into a casting mold.

Finally the heat transfer from the liquid metal **12*a* to the remaining solid charge 12 melts all of the charge 12 except for a rim of metal which rests directly on the support 18. When the portion of the solid charge 12 adjacent to opening 20 finally melts through, the liquid metal will pass through opening 20 and will fall into the opening 30 of casting mold 32, or some other container. The charge 12 may be sized so as to have the same volume as casting mold 32. Because support 18 is kept at a relatively low temperature by the cooling means of tube 24 and internal cavities 22, the metal in close proximity to support 18, designated 26 in FIG. 4**, will remain solid.

It should be repeated that the purpose of the field which is supplied by the extra coil turns 14 towards the lower portion of the charge 12 is to confine the liquid charge **12*a* to the space within the coil 10 and to provide strong forced convective flow within the liquid charge, and not to levitate it or support its weight. The weight of the liquid metal 12*a* is supported by the solid metal 12 remaining unmelted at the bottom of the charge, until the proper pouring temperature has been obtained. Because the force needed to confine the liquid charge 12*a*** is a function only of the height and density of the metal, increased charge weights may be melted merely by increasing the diameter of the charge and support ring.

In induction melting, it is occasionally necessary to provide liquid metal in a narrow temperature range, or to superheat the metal; that is, heat it to a temperature in excess of its melting point. By placing the charge 12 only partially within the coil 10, the portion of the charge 12 within the coil may be superheated without melting the bottom portion of the charge 12 and causing the liquid metal to pass through opening 20 prematurely. Only when the liquid metal 12*a* is at its desired temperature is the charge placed entirely within the coil 10; then, melting of the remaining charge is rapid and the molten alloy 12*a*, at the desired temperature, runs into the waiting casting mold.

Figure 5:
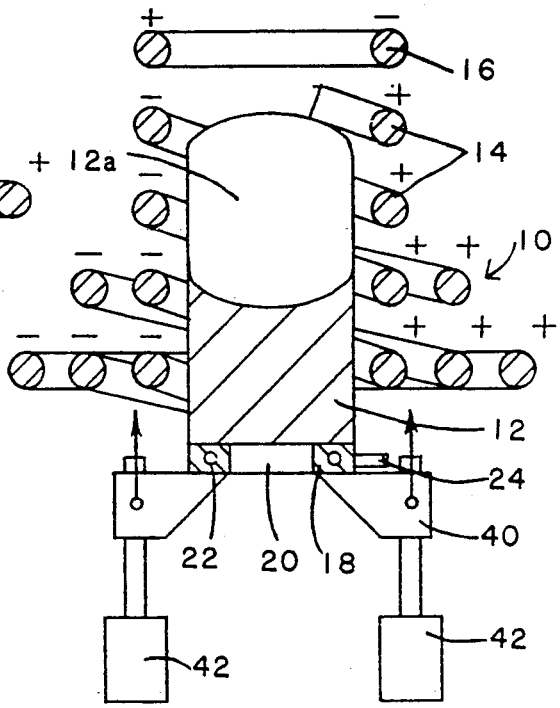
FIG. 5 is a schematic view of an alternate embodiment of the present invention, wherein the charge to be melted is mounted on a platform movable relative to the induction coil.

This accurate control of the melting process may be achieved by the embodiment shown in FIG. 5. Here the support ring 18 is attached to a lifting device comprising a vertically movable platform 40, which in turn is mounted on pylons 42. The lifting device may be actuated by pneumatic, hydraulic, mechanical, electrical, or other means. As charge 12 starts to melt, the charge 12 and support ring 18 are positioned somewhat below the induction melting coil 10, so that the lower part of the charge 12 is not affected by the induction field. In this lower position, only the top portion of charge 12 will be melted within the coil 10. When the molten portion at the top of charge 12 reaches the desired pouring temperature, the lifting device is actuated and raises the charge fully into the induction coil. Melting of the remaining portion of the charge is rapid, and the molten alloy 12*a*, at the desired temperature, runs into the waiting casting mold. For accurate control of the melting process, what is necessary is to provide relative movement between the charge 12 and the coil 10. The charge may be movable relative to a fixed coil, as in FIG. 5, or the coil may be movable relative to a fixed solid charge.

Figure 6:
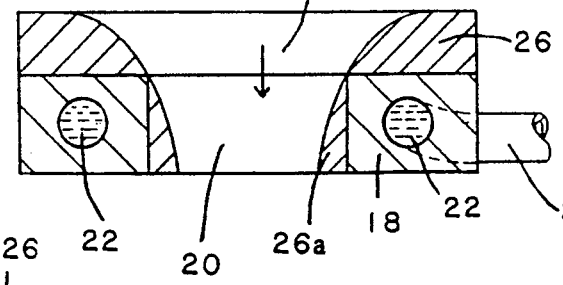
FIGS. 6 and 7 are detailed views of the support.

The outflow of molten metal through opening 20 in support 18 is illustrated in greater detail in FIG. 6. As previously described, support 18 is kept at a temperature lower than the melting point of the charge being melted, for example, by circulating a cooling fluid through passages 22 in support 18. Because support 18 is kept at a temperature below the melting point of the charge, a small amount of charge 12 will remain solid and will form an annular rim 26 which overlies and is concentric with support 18. In addition, once charge 12 melts through and molten metal begins to flow through opening 20, some metal 26*a* will freeze on the inner surface of opening 20.

In normal operation, it is expected that the "hole" melted in the bottom of the charge 12 will not be larger than the diameter of opening 20. In normal operation, therefore, there will always be a quantity of solid metal that surrounds support 18, so that the molten metal never comes into physical contact with support 18. However, that may not always be the case.

Figure 7:
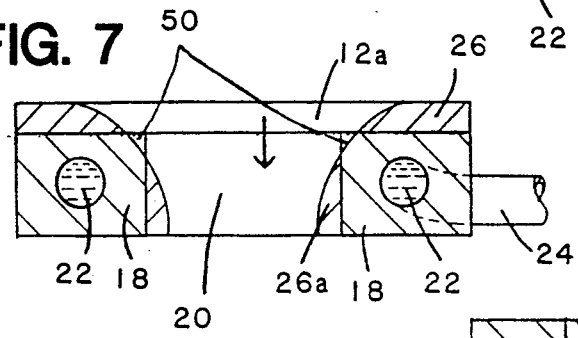

FIG. 7 shows what happens when the "hole" melted in the bottom of the charge is larger than the diameter of opening 20. In that case, annular rim 26 will not overlie the entire top surface of support 18 but will be recessed from the edge of opening 20, leaving a sharp edge 50 of support 18 exposed. This means that molten metal flowing through opening 20 will come into contact with support 18, and will become contaminated by the contact with it. The sharp edge 50 may also be melted by the molten metal flowing through opening 20, contaminating the melt to such a degree that the resulting casting may be unusable.

Figure 8:
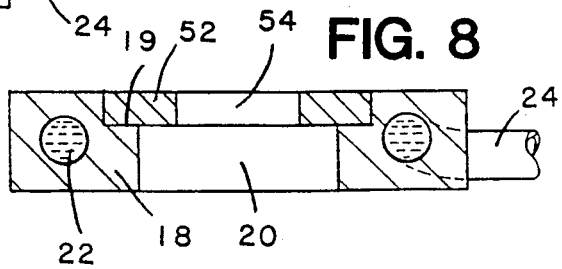
FIG. 8 shows an alternate embodiment of a support of the present invention.

In order to remedy this problem, a melt ring 52 with an opening 54 therethrough can be used, as shown in FIG. 8. The melt ring 52 is mounted around the top edge of the opening 20 in support 18. Support 18 may be provided with a step 19 on which the melt ring 52 can be supported. Melt ring 52 is made of a material identical to that of the charge 12. Opening 54 is smaller than opening 20 so that even if the hole of liquid metal in annular ring 26 is larger than opening 54, the liquid metal 12*a* will not erode melt ring 52 as far back as support 18. The idea is that the molten metal 12*a*, instead of melting the top edge of opening 20, will melt the melt ring 52. However, since the molten metal 12*a* is of an identical material as melt ring 52, molten metal from melt ring 52 will not contaminate molten metal 12*a* as it passes through the support 18.

The process described above avoids crucible contamination and reaction by eliminating the crucible entirely from the melting process. Also, because of the strong convection current established in the liquid metal by the electromagnetic forces, the liquid will be exceptionally homogeneous.

The method of the present invention may be used in air, in a vacuum, or in a controlled atmosphere.

It should be clear that the method of the present invention lends itself to automatic production quite readily, as no separate pouring operation is required. Where the proper pouring temperature is achieved without the use of a lifting device such as that shown in FIG. 5, pouring will take place when the requisite amount of energy for melting the bottom of the charge has been transferred to the charge. By adding an optical or infrared temperature measuring device, a control circuit can be designed so that, when superheat control is desired, the signal from the temperature measuring device can activate the lifting device as well as control the power supply.

It should also be noted that the rim of unmelted metal 26 which remains after the melting process is completed is ideal for recycling; as it has suffered no contamination from the melting process.

The present invention eliminates the need for and use of crucibles. Therefore, it completely eliminates reactions between the metallic charge and the crucible, as well as the contamination of the metal by the crucible or its reaction products. It also eliminates the expense of purchasing, storing, handling, and disposing of crucibles. Because there is no danger of reaction with the crucible, the present invention allows reproducible control of superheating liquid metals in an automatic melting and pouring process. The present invention is far more energy efficient than cooled-crucible melting processes, as no energy is lost from the melt to the cooled crucible walls. It is also far more energy efficient than levitation, as no energy is spent suspending the metal. It has been found that the apparatus of the present invention can melt charges of masses up to ten times that of the Birlec process and its derivatives.

The present invention may be embodied in other specific forms without departing from the spirit or essential attributes thereof and, accordingly, reference should be made to the appended claims, rather than to the foregoing specifications, as indicating the scope of the invention.

We claim:

1. Apparatus for inductively melting a quantity of metal without a container, comprising:

an induction coil having a plurality of turns defining a volume for receiving a quantity of metal, the induction coil being adapted to exert an electromagnetic force on the metal which increases toward the bottom portion of the metal;

means for energizing the coil;

a support means for supporting the metal from below and having an opening therethrough; and means for maintaining the support means at a preselected temperature.

2. Apparatus as in claim 1, further comprising a means for preventing levitation of the metal.

3. Apparatus as in claim 1, wherein said support means is in the form of an annulus.

4. Apparatus as in claim 1, wherein said means for maintaining the support means at a preselected temperature comprises at least one channel in said support means through which a cooling fluid is circulated.

5. Apparatus for inductively melting a quantity of metal without a container, comprising:

an induction coil having a plurality of turns disposed around said quantity of metal, said induction coil adapted to provide a greater electromagnetic force towards the lower portion of the quantity of metal within said induction coil, the topmost of said turns being wound in a direction opposite that of the others of said plurality of turns;

means for providing an electric current through said induction coil;

support means having an opening therethrough, substantially in contact with the bottom surface of said quantity of metal; and means for maintaining said supporting means at a preselected temperature.

6. Apparatus as in claim 5, further comprising a melt ring disposed around the rim of the opening in said support means, said melt ring being of a material identical to that of the quantity of metal.

7. Apparatus as in claim 5, further comprising a casting mold having an inlet opening in communication with said opening in said support means.

8. Apparatus as in claim 5, wherein said support means is movable, relative to said induction coil.

9. Apparatus as in claim 5, wherein said support means is in the form of an annulus.

10. Apparatus as in claim 5, wherein said means for maintaining the support means at a preselected temperature comprises at least one channel in said support means through which a cooling fluid is circulated.

11. A method of inductively melting a quantity of metal without a container, comprising the steps of:

placing said quantity of metal within an induction coil;

producing an electromagnetic field within said induction coil, said electromagnetic field inducing eddy currents within said quantity of metal and electromagnetic forces against the surface of said quantity of metal, said electromagnetic force being stronger towards the lower portion of said quantity of metal, thereby causing said quantity of metal to melt from its top portion downwards;

melting said quantity of metal so that heat transfer from the liquid part of said quantity of metal will melt all of the remaining solid part of said quantity of metal except for a rim of solid metal in contact with a support means disposed at the bottom surface of said quantity of metal; and further melting said quantity of metal so that said liquid part of said quantity of metal will flow through an opening in said rim of solid metal and an opening in said support means.

12. A method as in claim 11 further comprising the step of collecting said liquid part of said quantity of metal in a casting mold disposed beneath said opening in said support means.

13. A method as in claim 11 further comprising the steps of placing the quantity of metal partially within the electromagnetic field, until the portion of the quantity of metal within the electromagnetic field reaches a preselected temperature, and then placing the entire quantity of metal within the electromagnetic field.

* * * * *